United States Patent [19]

Grombka

[11] 4,137,748

[45] Feb. 6, 1979

[54] WEDGING STRUCTURE FOR PRESSES OR THE LIKE

[75] Inventor: Walter J. Grombka, Tiffin, Ohio

[73] Assignee: The National Machinery Company, Tiffin, Ohio

[21] Appl. No.: 837,590

[22] Filed: Sep. 28, 1977

[51] Int. Cl.[2] ..... B21J 13/02

[52] U.S. Cl. ..... 72/448; 100/53

[58] Field of Search ..... 72/448, 447, 446, 452; 100/257, 53

[56] References Cited

U.S. PATENT DOCUMENTS

| | | | |
|---|---|---|---|
| 1,716,414 | 6/1929 | Beyer | 100/257 |
| 2,826,947 | 3/1958 | Creek | 72/448 |
| 3,538,201 | 6/1971 | Topaz | 100/53 |
| 3,889,515 | 6/1975 | Grombka | 100/53 |

FOREIGN PATENT DOCUMENTS

| | | | |
|---|---|---|---|
| 211129 | 9/1960 | Austria | 72/447 |
| 744057 | 2/1956 | United Kingdom | 72/448 |

*Primary Examiner*—C. W. Lanham
*Assistant Examiner*—Gene P. Crosby
*Attorney, Agent, or Firm*—McNenny, Pearne, Gordon, Gail, Dickinson & Schiller

[57] ABSTRACT

A wedge system is disclosed for adjustably positioning tools in a forging press or the like. The system includes a wedge positioned between two assemblies and provided with a locking taper. Hydraulic means permit lubricant to be supplied under pressure to the surface of the wedge so that the wedge is released and can float laterally when large loads are applied to the system, as for example during a tooling jam. Means are provided to prevent substantial separation between the interfaces of the wedge and the remainder of the system when hydraulic fluid is applied to prevent seal extrusion or blowout. The seals are arranged to prevent blowout or extrusion when the associated faces are separated a substantial amount. Further, a hydraulic actuator is provided to take up the load on the mechanical adjusting screws prior to release of the jam and to control the movement of the wedge once it is released.

18 Claims, 7 Drawing Figures

WEDGING STRUCTURE FOR PRESSES OR THE LIKE

BACKGROUND OF THE INVENTION

This invention relates generally to a forging press or the like and, more particularly, to an improved bed frame die support wedge system and to a press incorporating such system.

PRIOR ART

On occasion a forging machine or the like becomes jammed with the slide in its forward, dead-center position. In the past, it has often been necessary to burn out or cut away the dies or their supports to free the slides for retraction. Various systems to overcome this problem have been proposed. British Pat. No. 744,057, published Feb. 1, 1956, and my United States Letters Pat. No. 3,889,515, granted June 17, 1975, describe systems for releasing such a jam, in which means are provided to introduce fluid under pressure along the wedge faces to release the main wedge of the support system and allow it to move, even though extreme loads are encountered during a jam. Such systems employ seals along the interface between the wedge and the remainder of the bed frame die support which cooperate to confine the fluid under pressure and create what amounts to a short stroke actuator, which opposes the force of the jam transmitted through the dies to the wedge system. When sufficient pressure is introduced along the interface, the wedge surfaces separate, allowing the wedge to float and move freely to a release position.

Such systems have not provided satisfactory performance in situations in which the die transmitted force and the fluid produce force are offset from each other. In such instances, the various parts of the wedge system tend to tip and separate along one zone, while wedge contact remains along other zones to prevent wedge release. When a sufficient clearance occurs, due to such tipping action, the seals tend to extrude out or blow out of their retaining grooves. When the seals fail, the system fails to function to release the jam.

SUMMARY OF THE INVENTION

The present invention provides an improved fluid pressure system for releasing jams in forging presses or the like which occur when the slide stalls in the forward position. With such systems, jams can be released, even though the load on the dies is eccentric with respect to the center line or line of action of the fluid pressure system.

In the illustrated embodiment of this invention, means are provided to limit the tipping of the wedge system, even when eccentric loads are encountered. The illustrated means for performing this function are wedges which act between the machine frame and the cap or cover member of the wedge system along opposite sides thereof to prevent any one portion of the cover member from lifting a substantial amount.

Further, in the illustrated system the seals are arranged to prevent seal extrusion or blowout, even when a substantial amount of clearance is developed between the surfaces of the wedge and the mating surfaces of the system.

Still further, in the present illustrated embodiment a fluid pressure actuator is provided to release the pressure on the wedge locking screws and to control wedge movement after it is released.

A system in accordance with this invention reliably functions to release jams with a minimum of machine downtime and without encountering machine or die damage.

DETAILED DESCRIPTION OF THE DRAWINGS

The illustrated embodiment of this invention is similar in many respects to the wedging system described in my prior U.S. Letters Pat. No. 3,889,515, and such patent is incorporated herein by reference.

Figure 1:
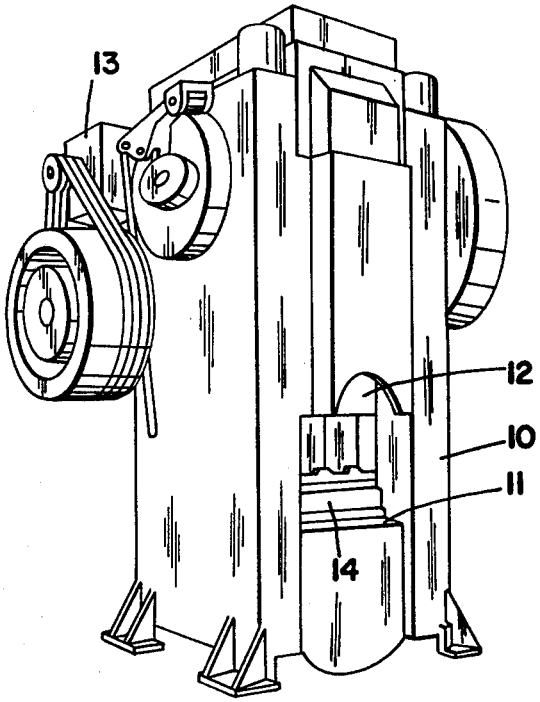
FIG. 1 is a perspective view of a typical forging press of the general type to which the present invention is particularly suited.

FIG. 1 illustrates a typical forging press having a frame 10 providing a die bed 11 and a slide 12 reciprocable toward and away from the die bed 11. The slide is powered by motor 13 and is driven by a crank and pinion drive-type linkage. Positioned on the die bed 11 is a die support wedge system 14 incorporating the present invention. This wedge system 14 adjustably positions the fixed dies in the frame 10 of the machine. The wedge system is adjustable to raise and lower the fixed dies so that they are properly positioned with respect to the movable dies or tools carried by the slide.

Figure 2:
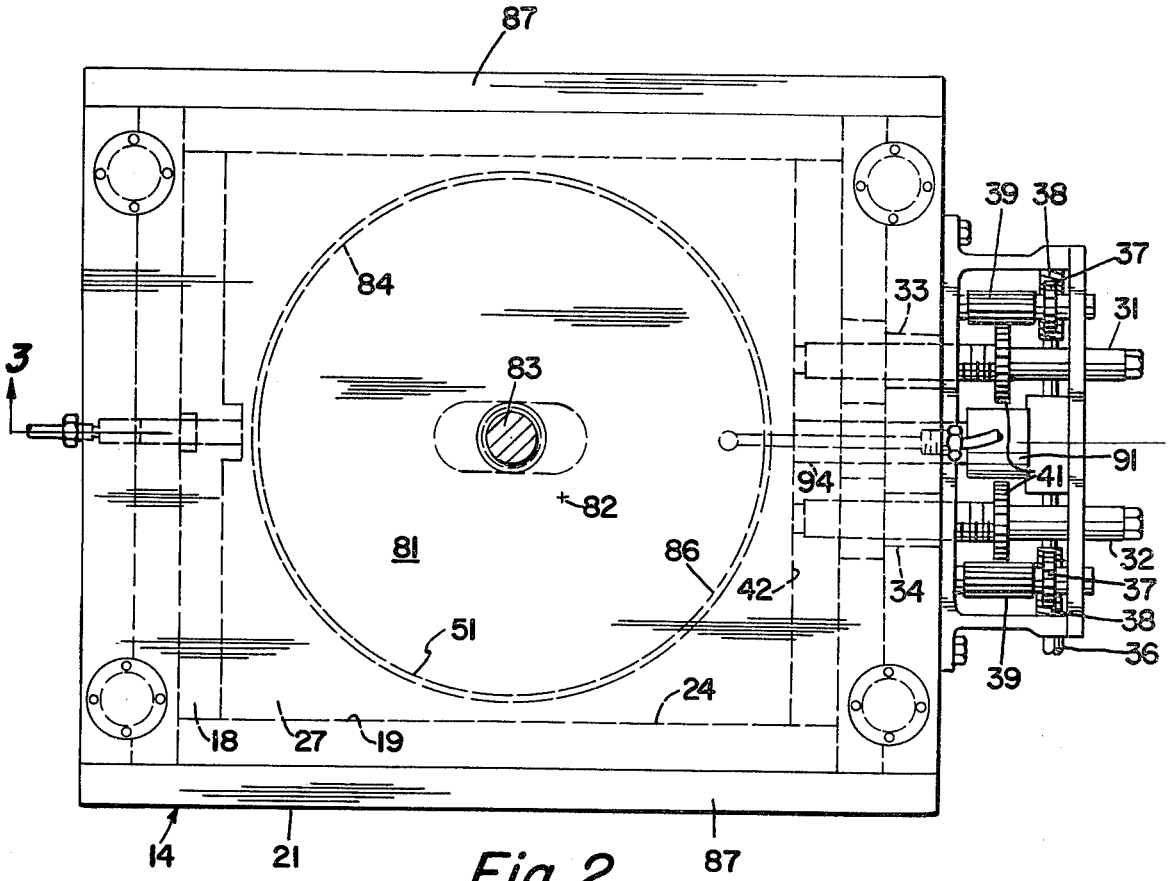
FIG. 2 is a plan view of the wedge support system incorporated in the present invention.
Figure 3:
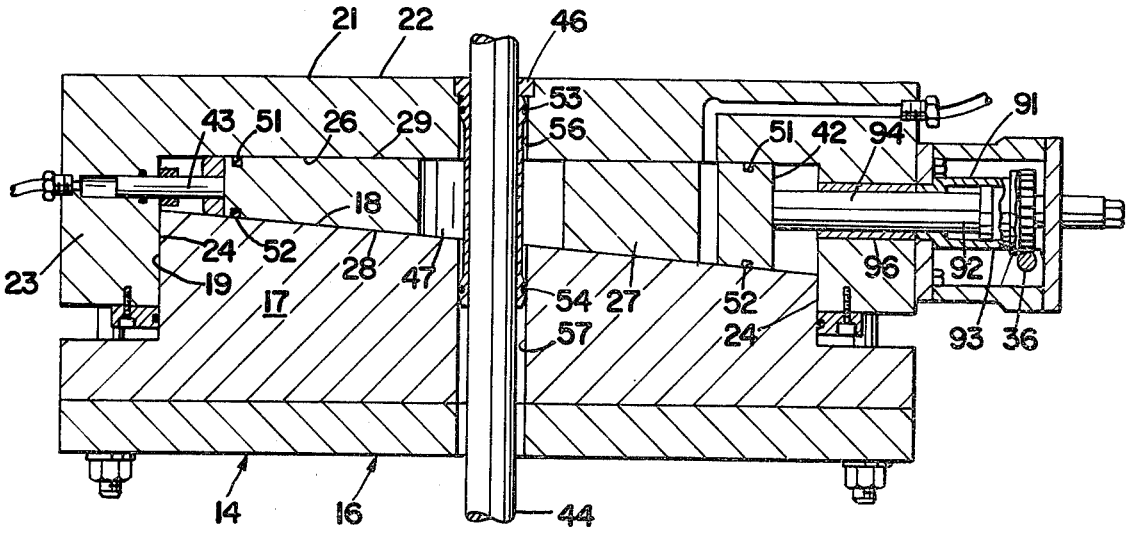
FIG. 3 is a cross section taken generally along line 3—3 of FIG. 2.

Referring to FIGS. 2 and 3, the die support wedge system 14 includes a base plate assembly 16, which is secured to the die bed 11 of the machine. The base plate assembly includes an upwardly projecting, generally rectangular, integral wedge portion 17 provided with an inclined upper wedge surface 18 and sidewalls 19.

Positioned above the base plate assembly 16 is a cover plate 21 having an upper surface 22 which supports a die set or bolster. The cover plate 21 is formed with depending walls 23 having inner surfaces 24 proportioned to closely fit the sidewalls 19 to prevent lateral movement between the base plate assembly 16 and the cover plate 21. The mating walls, however, permit vertical movement of the cover plate with respect to the base plate.

Positioned between the wedging surface 18 and the lower horizontal surface 26 of the cover plate 21 is a wedge 27. The terms "horizontal" and "vertical" are used herein to simplify the description. However, the invention does not require such orientation, and the system can be used in other orientations. The lower surface 28 of the wedge engages the wedge surface 18 and the upper surface 29 of the wedge engages the surface 26 of the cover plate. The two wedge surfaces 18 and 28 are inclined at a locking angle with respect to the surfaces 26 and 29. Preferably, this angle is in the order of 4 degrees. Consequently, vertical loads applied to the cover plate do not tend to produce lateral movement of the wedge 27 with respect to the two plate assemblies.

The position of the wedge 27 is determined by a pair of screws 31 and 32, which are threaded through bushings 33 and 34, respectively, in the wall 23. A power drive is provided for the screws 31 and 32, which includes a shaft 36 extending laterally with respect to the screws 31 and 32 and providing similar but opposite gear trains to drive the screws 31 and 32 in a similar manner. Each gear train includes a worm gear 37 mounted on the shaft 36, which meshes with a worm wheel 38 to rotate an elongated gear 39. The elongated gears 39 mesh with driven gears 41 mounted on the screws 31 and 32. Consequently, the two screws 31 and 32 are connected so that they move in or out together.

Two screws 31 and 32 extend through the sidewall 23 and engage at their inner ends with the end wall 42 of the wedge 27 to locate the wedge 27 with respect to the two plate assemblies. When the screws are threaded outwardly, the wedge 27 is allowed to move to the right, as viewed in FIGS. 2 and 3, causing the cover plate to be lowered. When the screws are threaded inwardly, the wedge 27 moves to the left and raises the cover plate. Because the screws 31 and 32 extend parallel to the surface 26 and are mounted on the cover plate, there is no vertical movement between the screws and the wedge during the wedge adjustment.

A hydraulically actuated plunger 43 extends from the opposite wall, as viewed in FIG. 2., and engages the narrow end of the wedge. The plunger is pressurized to ensure that the wedge moves to the right when the screws are backed out to allow lowering of the cover plate.

A hydraulically operated locking system is provided to releasably lock the screws 31 and 32 in their adjusted position. Reference should be made to my prior U.S. Pat. No. 3,889,515 for a detailed description of such locking mechanism. Similarly, a hydraulic clamping system is provided including a clamping device at each of the four corners of the cover plate. Here again, reference should be made to my prior patent for a detailed description of such a clamping system.

An ejector pin 44 extends upwardly through a sleeve 46 in the center portion of the wedge system to operate the ejector device within the various dies supported by the wedge system. The wedge is provided with an elongated clearance opening 47 to permit the adjustment movement of the wedge with respect to the sleeve without interference.

A hydraulic system is provided to allow the release of the wedge in the event that a jam occurs when the slide is in its lower dead-center position. This system includes a pair of ring seal assemblies 51 and 52, with the assembly 51 positioned in a groove in the upper face of the wedge 27 for sealing engagement with the surface 26 and the seal assembly 52 positioned in the groove in the lower face of the wedge 27 for sealing engagement with the wedging surface 18. A second pair of seals 53 and 54 are mounted in grooves on the sleeve 46 with the seal 53 providing sealing engagement with the wall of the bore 56 in the cover plate 21 and the second seal 54 providing sealing engagement with the bore 57 in the base plate assembly 16. All of the seals 51 through 54 are arranged to allow substantial movement or separation between the two surfaces 26 and 29 and 18 and 28 without seal extrusion or blowout.

Figure 4:
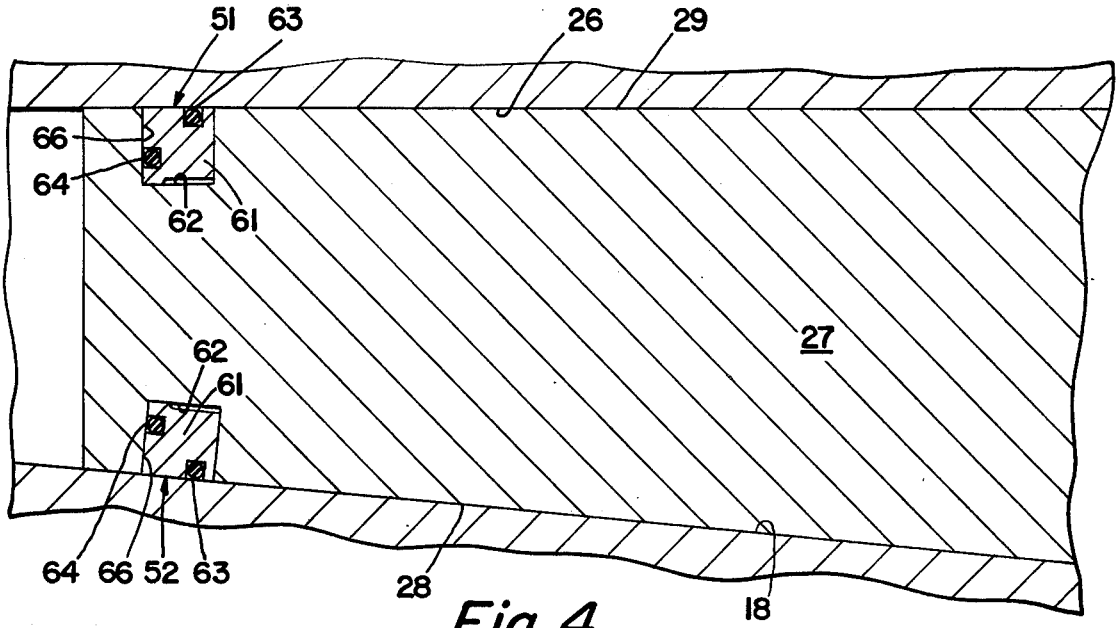
FIG. 4 is an enlarged, fragmentary section illustrating a structural arrangement of the outer seals on the main wedge.

Referring to FIG. 4, each of the seal assemblies 51 and 52 includes a ring 61 positioned within an associated circular groove 62 in the wedge 27 and opened to the associated face 28 or 29. Each ring is provided with an O-ring receiving groove on its exposed face, in which is positioned an O-ring seal 63. The O-ring seal 63 of the seal assembly 51 engages the surface 26 of the cover member and the seal 63 of the assembly 52 engages the surface 18. Each ring is also formed with an outer groove in which is positioned an O-ring type seal 64, which seals against the associated groove wall 66.

With this structure, fluid under pressure along the interface between the two surfaces 26 and 29 and along the interface between the two surfaces 18 and 28 is confined by the seal 63, but extends into each groove and under the rings 61 to the zone of the seals 64. Because the fluid under pressure extends along the inner surface of each of the seal assemblies and radiially beyond the seal 63, a hydraulically unbalanced force is developed on the ring urging the ring in the direction of the associated surface 26 or 18. To accomplish this purpose, it is merely necessary to arrange the seal 63 so that it is radially inward with respect to the associated seal 64 to provide an unbalanced area in which the fluid under pressure reacts to urge each of the rings in an outward direction.

With this structure, if a hydraulic force between either of the interfaces tends to cause separation of the surfaces of the interface, the ring 61 moves out of the associated groove 62 to maintain tight contact with the associated surface 18 or 26, and thus prevent any extrusion or blowout of the seal 63. During such movement, the seal 64 merely moves along the associated surfaces 66.

In this particular structure, the surfaces 26 and 29 can separate a distance equal to the spacing between the face of the seal ring 61 and the seal 64 before any possibility of seal failure occurs. Consequently, it is not necessary to maintain substantial engagement between the surfaces along each of the interfaces of the system to prevent seal extrusion or blowout.

Figure 5:
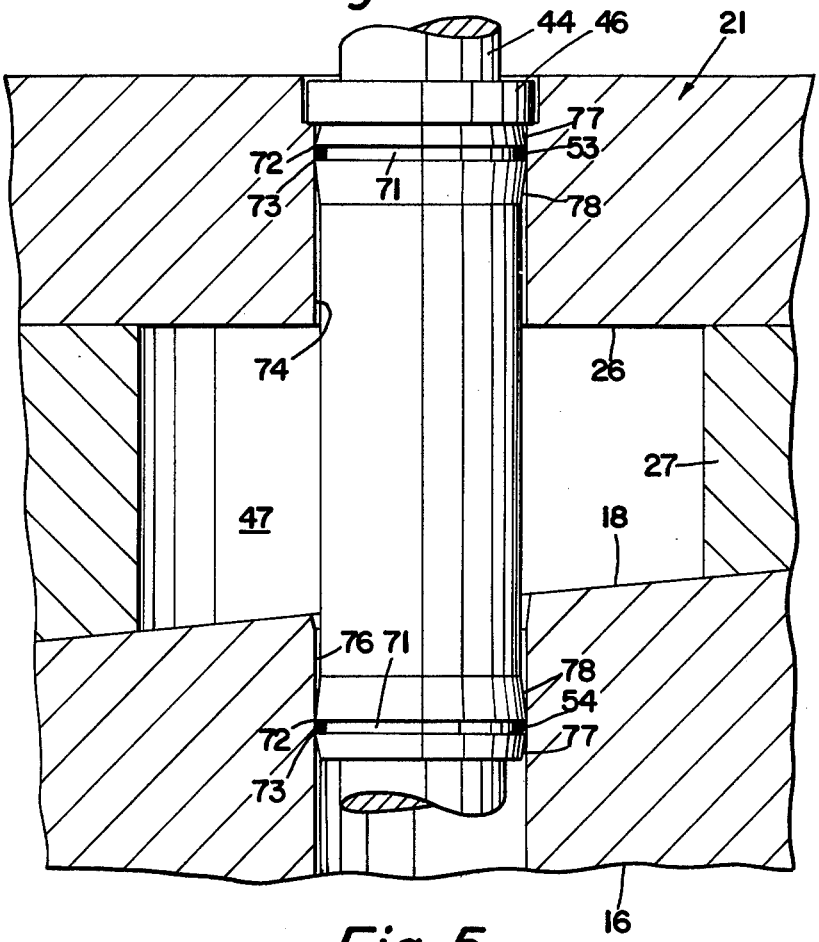
FIG. 5 is an enlarged, fragmentary section illustrating the structure of the seal system on the sleeve surrounding the knockout pin.

Referring to FIG. 5, the structural arrangement of the seals 53 and 54 is also arranged to accommodate a substantial amount of separating movement between the surfaces 18 and 26. As illustrated, each of the seals 53 and 54 is located in a seal groove 71 formed in the sleeve 46. Immediately adjacent the seal grooves 71 at 72 and 73, the sleeve is formed with a diameter to closely fit the adjacent bores 74 and 76 formed in the cover plate 21 and the base plate assembly 16, respectively. The sleeve, however, is tapered back from such edges at 72 and 73, providing essentially conical surfaces 77 and 78, to provide clearance and allow tipping between the cover plate 21 and the base assembly 16. Further, the principal diameter of the sleeve 46 between the two surfaces 78 is sized to provide clearance with the respective bores 74 and 76. With this structure, tipping action can occur between the cover and the base assembly without allowing extrusion or blowout of the seals and without producing interference in the system. Further, the seal 54 is located at a distance from the surface 18 so that it can slide along the associated bore 46 a substantial distance before the close fit is lost. Consequently, the sleeve seals can allow tipping and separation movement between the various parts of the assembly without encountering seal failure.

It should be understood that the seals 51, 52, 53, and 54 define a hydraulic zone 81 which is generally circular in shape around the sleeves 46. Consequently, when fluid under pressure is admitted to such zone, it produces a hydraulic force reaction, tending to separate the wedge surfaces from the mating surfaces of the assembly, which force has a line of action essentially along the axis of the knockout pin 44 when the wedge is adjusted to its mid-position illustrated. The outer boundary of such zone, however, moves with the wedge during adjustment.

If the line of action of the force transmitted through the dies by the jam coincides with the axis of the pressure zone 81, the tendency for the cover 21 to tip with respect to the base assembly is not particularly significant. However, in most instances the line of action of the die-transmitted force is spaced from such hydraulic force center or line of action and there is a force movement developed, tending to tip the cover 21 with respect to the base.

For example, if the line of action of the die-transmitting force is located at point 82, as illustrated in FIG. 2, and the hydraulic force has a line of action 83 along the knockout pin 44, there is a tendency for the wedge surfaces to separate in the zone generally at 84, with a tipping type movement which allows tight engagement to be maintained along the wedge interfaces at a location generally at 86. In such an example, substantial spacing could occur in the zones 84 before the wedge is released, and if means were not provided to limit such tipping action, failure could result.

Figure 6:
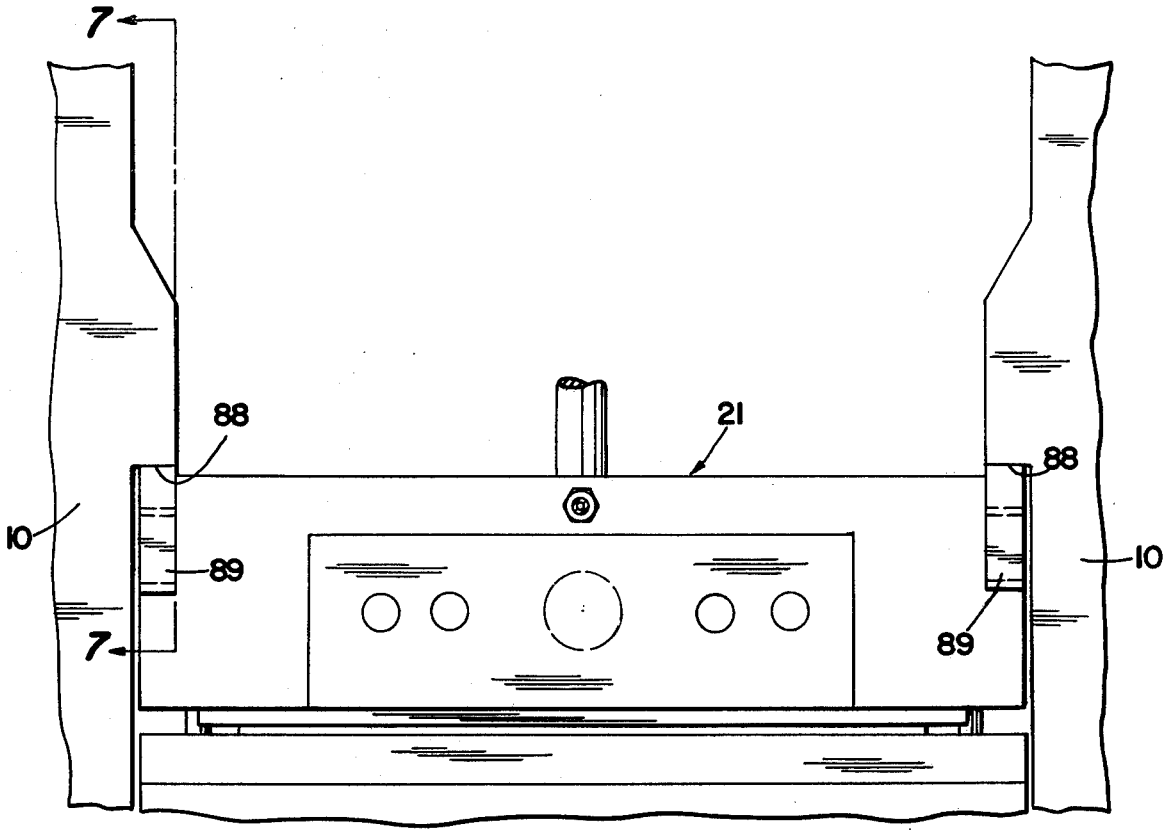
FIG. 6 is a fragmentary, side elevation of the system, illustrating the location of the side wedges, which engage the machine frame to limit tipping movement of the wedge system cover.
Figure 7:
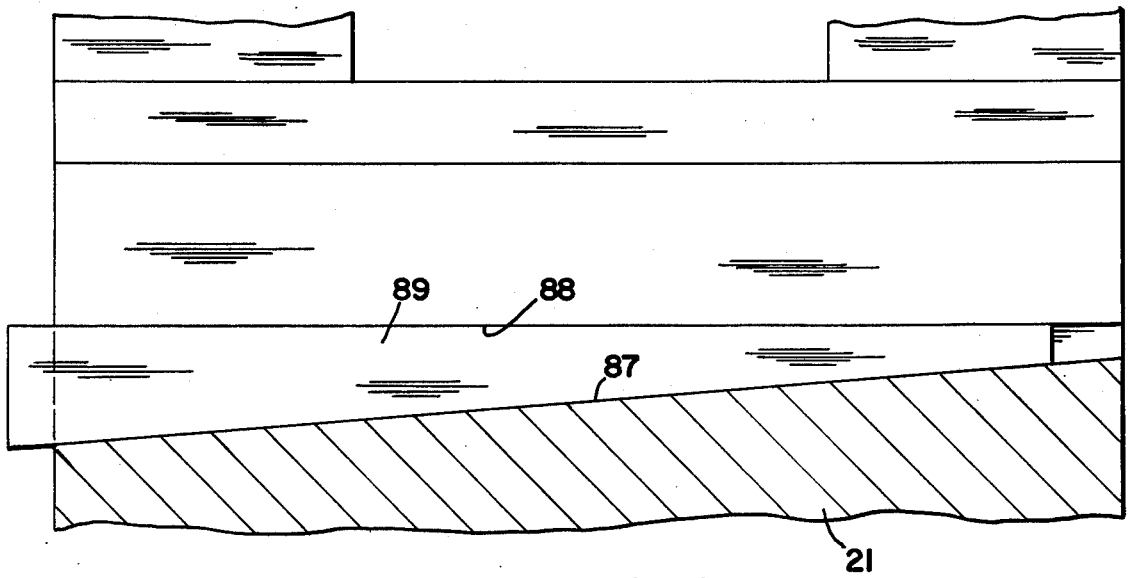
FIG. 7 is a lateral section, taken along line 7—7 of FIG. 6.

In order to prevent such tipping action, a structure, best illustrated in FIGS. 6, 7, and 2, is utilized. The cover plate 21 is provided with inclined wedge surfaces 87 along each side which are located directly below a horizontal, downwardly facing surface 88 on the frame 10 of the machine. A hold-down wedge 89 having a taper or angle to match the angle of the associated surface 87 is positioned between each surface 87 and its associated surface 88. Generally, the wedges 89 are removed while the main wedge 27 is being adjusted, but once proper adjustment is obtained, the wedges 89 are inserted along the opposite sides of the wedge assembly and are snugly positioned so that they remain in place during machine operation. If necessary, auxiliary means may be provided to maintain the wedges in position during machine operation.

In the event a jam occurs and hydraulic pressure is admitted to the main wedge zone, and in the event that an eccentric loading condition is encountered, as discussed above, the two wedges cooperate to prevent any substantial separation of the surfaces or tipping of the cover. In the example discussed above, in which the die-transmitted loading has a line of action at 82, the wedge located along the upper surface 87, as viewed in FIG. 2, would function to prevent excessive tipping or excessive separation in the zone 84 and would provide sufficient downward force to maintain the cover member 21 substantially horizontal. Then as additional pressure is applied, a relatively uniform separation occurs between the mating surfaces 26 and 29 along the upper surface of the wedge and the surfaces 18 and 28 along the lower surface of the wedge. When the film of liquid under pressure produces a separating force of sufficient value to overcome the force transmitted through the dies, the wedge is free to move to the right, as viewed in FIG. 3, to release the jam.

When a jam occurs, excessive forces can be developed against the screws 31 and 32, which produce excessive friction in the threads and prevent their proper operation during release of the jam. Also, if the screws are backed off before the wedge is released by the hydraulic system described above, the wedge will move with extremely high velocities when it is initially released by the hydraulic system, with the possibility of causing damage to the screws and wedge.

In order to overcome both of these difficulties, a hydraulic actuator 91 is provided, which includes a piston 92 located within a cylinder 93. Its piston rod 94 extends through a bushing 96 and engages the end wall 42 of the wedge midway between the two screws 31 and 32. Prior to the operation of the hydraulic system to release a jam, the cylinder 93 is pressurized to extend the piston rod 94 into engagement with the wedge surface 42 to take up the loads on the screws 31 and 32. After the screws 31 and 32 are relieved of the load by the piston rod 94, they are backed off. Subsequently, when the wedge is freed by the hydraulic system, its movement to the right as viewed in FIG. 3 is controlled by bleeding the actuator 91 so that it does not slam over against the screws.

With a die support wedge system in accordance with the present invention, it is possible to reliably and easily release jams, even when the load transmitted to the wedge systems through the dies is eccentric with respect to the center of the pressure zone 81. The wedges 89 prevent excessive tipping of the cover plate during release and the seals are structured to accommodate substantial clearance between adjacent surfaces without extrusion or blowout failure. Further, the movement of the wedge during the release is controlled by the actuator 91.

Although a preferred embodiment of this invention is illustrated, it is to be understood that various modifications and rearrangements of parts may be resorted to without departing from the scope of the invention claimed herein.

I claim:

1. A press or the like comprising a frame providing a die bed, a slide reciprocable in said frame toward and away from said die bed, a wedge system on said die bed operable to adjustably position stationary dies in said press, said wedge system including a laterally movable wedge formed with a locking taper, a plate member which is adjustable with respect to said die bed by movement of said wedge, seals along the face of said wedge operable to define a pressure zone along the interface of said wedge and the mating surfaces of said wedge system, hydraulic means operable to supply fluid under pressure to said zone with sufficient pressure to release said wedge for lateral movement even when said slide is jammed in its dead center position, mechanical stop means operable to positively limit movement of said plate under the influence of hydraulic pressure to prevent seal blowout or extrusion of said seals.

2. A press as set forth in claim 1, wherein said stop means interact between said plate member and said frame.

3. A press as set forth in claim 1, wherein said system includes mechanical jacking means for adjustably positioning said wedge, and a hydraulic actuator provided to relieve the force on said jacking means when a jam occurs and to control the movement of said wedge when it is released by said hydraulic means.

4. A press as set forth in claim 1, wherein said stop means include wedges which are positioned between said plate member and frame to adjustably lock said plate member in its adjusted position.

5. A press as set forth in claim 4, wherein said seals allow substantial separation along said interface of said wedge and the mating surfaces of said wedge system without blowout or extrusion of said seals.

6. A press as set forth in claim 1, wherein said seals allow substantial separation along said interface of said wedge and the mating surfaces of said wedge system without blowouts or extrusion of said seals.

7. A press as set forth in claim 6, wherein at least some of said seals include a groove open to a mating surface, a seal support in said groove, a first seal on said seal support providing sealing engagement with said mating surface and a second seal on said support providing sealing engagement with a wall of said groove which is substantially perpendicular to said mating surface, said seals and support providing an unbalanced area moving said seal support along said groove and maintaining said seal support against said mating surface when said wedge and mating surfaces move apart under the influence of fluid under pressure.

8. A press as set forth in claim 7, wherein said wedge system includes a central opening and a sleeve therethrough to receive an ejector pin, and some of said seals are located to provide a fluid tight joint between said sleeve and the parts of said wedge system on opposite sides of said wedge.

9. A press as set forth in claim 8, wherein said sleeve and the seals associated therewith are structured to allow tipping of said plate member without extrusion or blowout of said associated seals.

10. A press as set forth in claim 9, wherein said system includes mechanical jacking means for adjustably positioning said wedge, and a hydraulic actuator provided to relieve the force on said jacking means when a jam occurs and to control the movement of said wedge when it is released by said hydraulic means.

11. A wedge system or the like comprising a first and second plate assembly connected for movement in a first direction toward and away from each other, an inclined surface on one of said assemblies facing the other assembly, a wedge position between said inclined surface and said other assembly movable in a second direction substantially perpendicular to said first direction to permit movement of said assemblies in said one direction and to maintain them in an adjusted position, said wedge being formed with a locking taper whereby force applied to said asemblies in said first direction does not cause movement of said wedge in said second direction, seal means along the interface between said wedge and each of said assemblies operating to define a pressure zone at the interface of said wedge and each of said assemblies, hydraulic means to supply fluid under pressure to said zone to permit movement of said wedge in said second direction even when substantial forces are applied to said assemblies, and mechanical stop means operable to positively limit movement of said assemblies away from each other when fluid pressure is applied by said hydraulic means to prevent sufficient spacing to occur between said interfaces to cause seal blowout or extrusion.

12. A wedge system as set forth in claim 11, wherein said stop means includes additional wedges to adjustably lock said assemblies in their adjusted positions.

13. A wedge system as set forth in claim 11, wherein said seal means allow substantial separation between the interface of said wedge and said assemblies without blowout or extrusion of said seals.

14. A wedge system as set forth in claim 11, wherein said system includes mechanical jacking means for adjustably positioning said wedge, and a hydraulic actuator is provided to relieve the force on said jacking means even when substantial forces are applied to said assemblies.

15. A wedge system as set forth in claim 11, wherein at least some of said seals include a groove in one interface open to the mating surface, a seal support in said groove, a first seal on said support providing sealing engagement with said mating surface, and a second seal on said support providing sealing engagement with a wall of said groove substantially perpendicular to said mating surface, said seals and seal support providing an unbalanced area moving said support along said groove and maintaining said support against said mating surface when the surfaces at said interface move apart under the influence of fluid under pressure.

16. A wedge system as set forth in claim 14, wherein said wedge system includes a central opening and a sleeve extending therethrough, some of said seals being located to provide a fluid tight joint between said sleeve and both of said assemblies on opposite sides of said wedge.

17. A wedge system as set forth in claim 16, wherein said sleeve and the seals associated therewith are structured to allow tipping between said assemblies and separation thereof without extrusion or blowout of said seals.

18. A wedge system as set forth in claim 17, wherein said system includes mechanical jacking means for adjustably positioning said wedge, and a hydraulic actuator is provided to relieve the force on said jacking means even when substantial forces are applied to said assemblies.

* * * * *